US006256375B1

(12) United States Patent
Lu et al.

(10) Patent No.: US 6,256,375 B1
(45) Date of Patent: Jul. 3, 2001

(54) TARGET ANGLE MATCHING CATHODE STRUCTURE FOR AN X-RAY TUBE

(75) Inventors: Quan N. Lu, San Jose, CA (US); Stephen W. Gravelle, Mequon; Stephen S. Waite, Milwaukee, both of WI (US)

(73) Assignee: General Electric Company, Milwaukee, WI (US)

( * ) Notice: Subject to any disclaimer, the term of this patent is extended or adjusted under 35 U.S.C. 154(b) by 0 days.

(21) Appl. No.: 09/282,007

(22) Filed: Mar. 29, 1999

(51) Int. Cl.[7] ..... H01J 35/06
(52) U.S. Cl. ..... 378/136; 378/119; 378/121
(58) Field of Search ..... 378/119, 121, 378/122, 125, 136, 144

(56) References Cited

U.S. PATENT DOCUMENTS 4,736,400 * 4/1988 Koller et al. ..... 378/125
5,136,625 * 8/1992 Heiting et al. ..... 378/139
5,384,818 * 1/1995 One et al. ..... 378/132
5,384,819 * 1/1995 Ono ..... 378/132
5,668,849 * 9/1997 Sugiura et al. ..... 378/133

* cited by examiner

*Primary Examiner*—Robert H. Kim
*Assistant Examiner*—Allen C. Ho
(74) *Attorney, Agent, or Firm*—Barbara Joan Haushalter; Christian G. Cabou; Phyllis Y. Price

(57) ABSTRACT

A rotating x-ray tube comprises an anode assembly having an anode target for distributing heat generated at a focal spot. The x-ray tube further comprises a cathode assembly for producing X-rays upon impact with the anode. A target angle matching cathode cup structure is associated with the cathode assembly. The angled cathode cup structure creates a parallel surface between the cathode and the target to provide a focused electron beam.

10 Claims, 4 Drawing Sheets

TARGET ANGLE MATCHING CATHODE STRUCTURE FOR AN X-RAY TUBE

TECHNICAL FIELD

The present invention relates to rotating x-ray tubes and, more particularly, to rotating x-ray tubes which employ an angled cathode structure to maintain parallelism of the surface between the cathode and the x-ray target.

BACKGROUND ART

X-ray tubes used in medical diagnostic imaging are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In designing the cathode for an x-ray tube, the surface of the cathode is typically desired to be parallel to the target. However, there are instances that the surface between the cathode and the target are not paralleled by design. Unfortunately, if the surface between the cathode and the target is not paralleled, the focal spot will be skewed. The skew of the focal spot could cause the tube to be out of specification, resulting in failure. The focal skew is caused by the electron beams accelerating from the cathode and landing at different coordinates on the target because of the non-parallel surface.

In order to minimize focal skew, it is desirable for the surface between the cathode and the target to be parallel.

BRIEF SUMMARY OF THE INVENTION

The present invention provides for a target angle matching cathode design for an x-ray tube, for generating the desired parallel surface between the cathode and the target. Using the target angle matching technique to maintain parallelism of the surface between the cathode and the target minimizes the opportunity of the focal spot from being skewed.

A rotating x-ray tube comprises an anode assembly and a target. The target, associated with the anode assembly, distributes heat generated at a focal spot. A cathode produces X-rays upon impact with the anode. A target angle matching cathode cup creates a parallel surface between the cathode and the target. The target angle matching cathode cup maximizes the gap between a frame containing the cathode and anode, and the cathode. The angled cathode cup configuration also minimizes focal spot skew.

Accordingly, the present invention provides a parallel surface between the cathode and the target. This provides the advantage of minimizing focal skew.

DETAILED DESCRIPTION OF THE INVENTION

Figure 1:
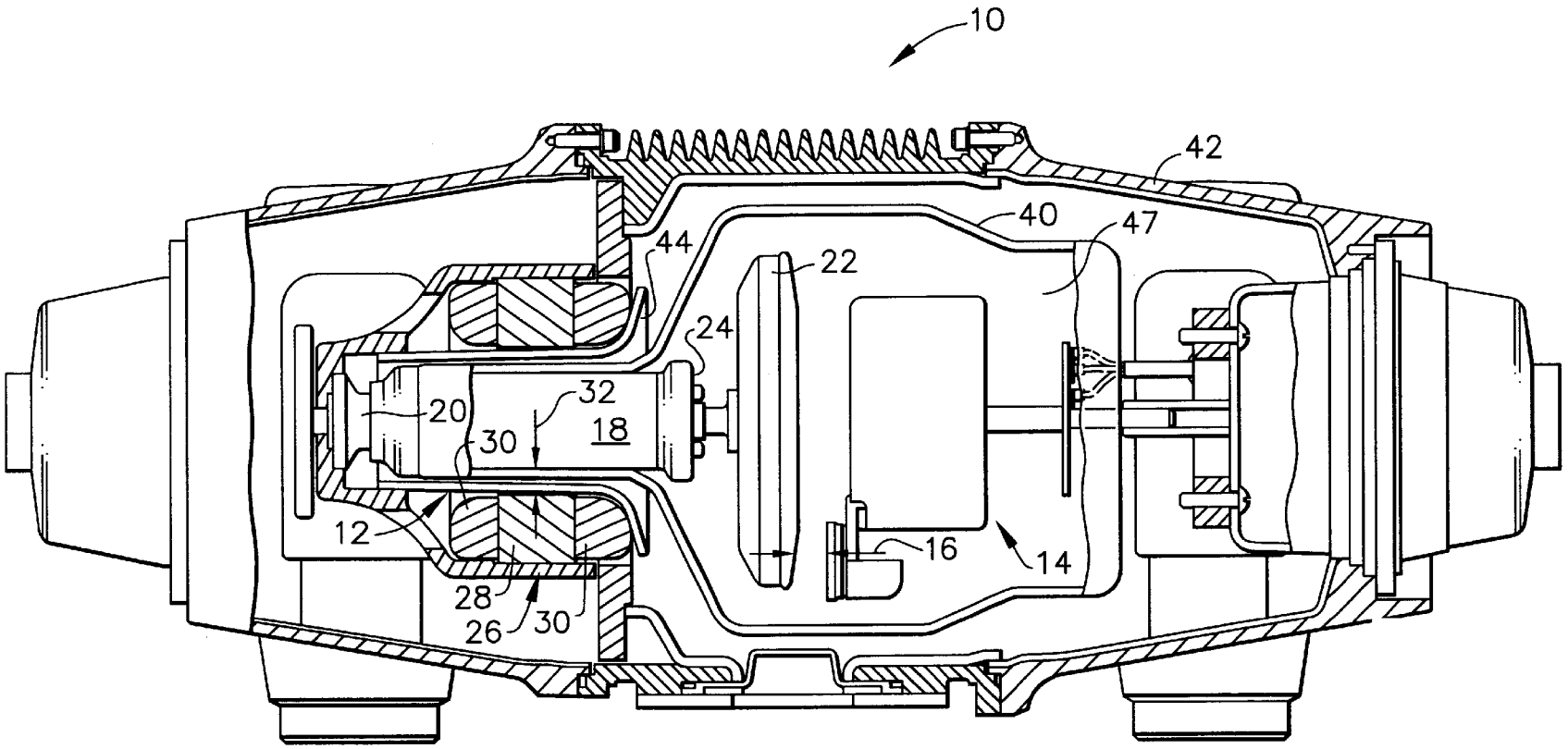
FIG. 1 (PRIOR ART)
FIG. 1 is a prior art cross-sectional illustration of a typical x-ray tube.

Referring to the drawings, FIG. 1 illustrates a typical prior art X-ray tube 10. The x-ray tube 10 has a rotating anode assembly 12, including an anode target 22, for the purpose of distributing the heat generated at a focal spot, and an x-ray tube cathode assembly 14 for providing a focused electron beam which is accelerated across a large anode-to-cathode vacuum gap 16 and produces X-rays upon impact with the anode.

Continuing with FIG. 1, the anode assembly 12 is rotated by an induction motor comprising a cylindrical rotor 18 built around a cantilevered axle 20. The cantilevered axle 20 supports the disc shaped anode target 22 connected via the hub and stud 24 to rotor 18 and cantilevered axle 20 which contains bearings facilitating rotation. The stator 26 of the induction motor includes an iron stator core 28 with copper windings 30 that surround the rotor 18. The rotor 18 of the rotating anode assembly 12, driven by the stator 26, is at anodic potential while the stator is referenced electrically to ground. Since the stator 26 operates at or near ground potential and the anode may be raised to 75,000 VDC positive with respect to ground, a large air gap 32, typically on the order of 0.400 inches or greater, is needed to maintain stable, discharge free operation. In a typical assembly, the anode assembly 12 and the cathode assembly 14 are sealed in a glass frame 40 and mounted in a conductive metal housing 42, and an insulation material 44 is provided between the stator 26, and the glass frame 40 and rotor 18.

Figure 2:
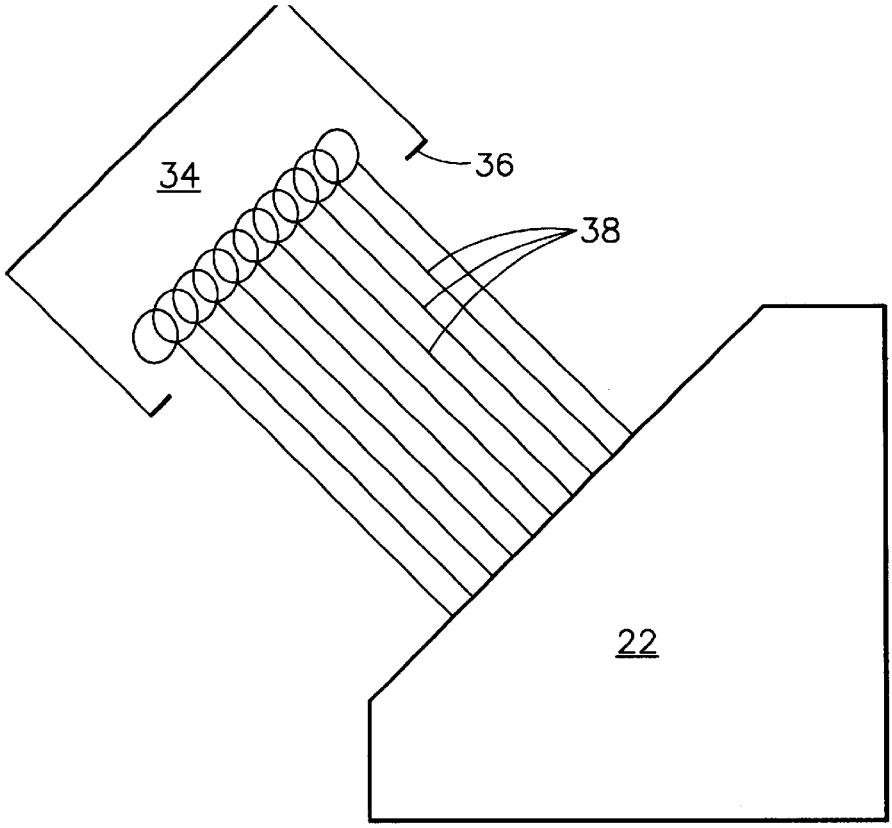
FIGS. 2–4 illustrate the relationship between the cathode and the target of an x-ray tube, such as is illustrated in FIG. 1, and certain of the problems with such a structure.
Figure 3:
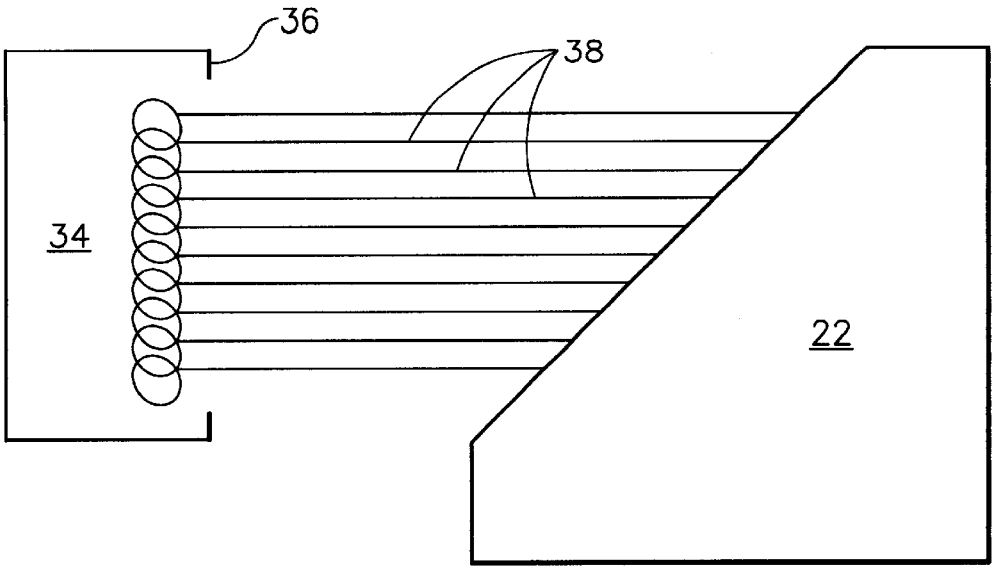
Figure 4:
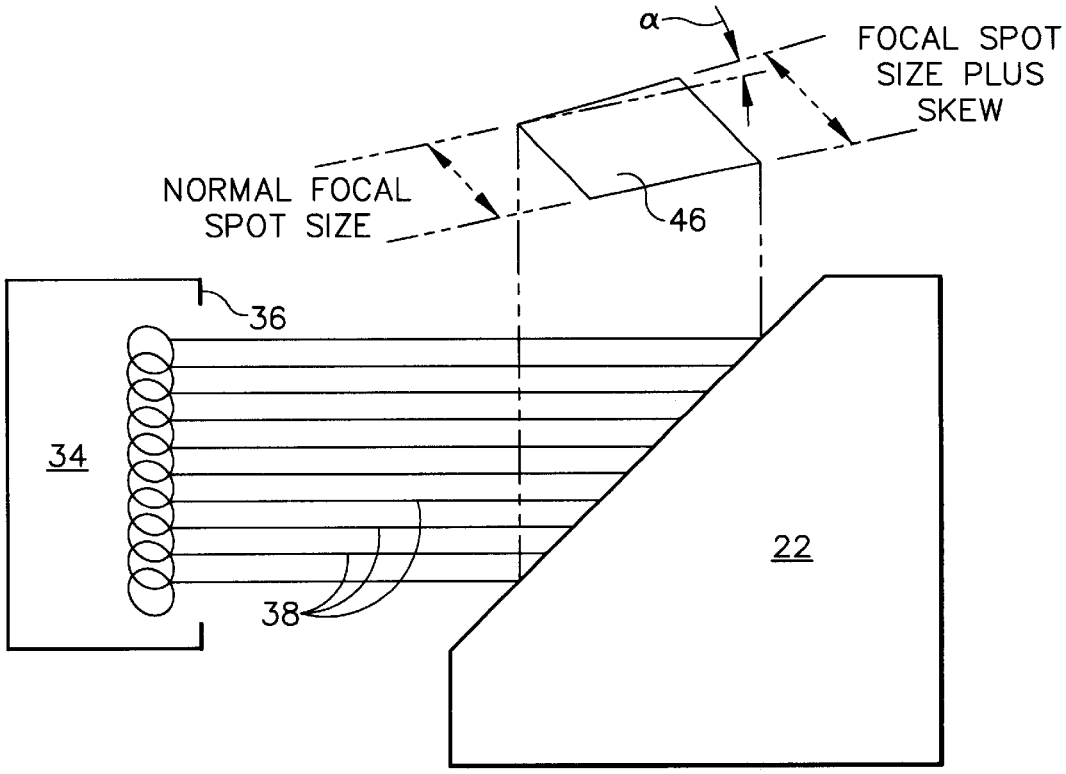

Referring now to FIGS. 2–4, in designing a cathode 34, associated with cathode structure 14 of FIG. 1, it is generally desirable to design the cathode so that its surface 36 facing the target 22 is parallel to the target, as shown in FIG. 2. Electrons 38 transfer between the surface 36 and target 22. However, in some x-ray tube designs, the surface 36 between the cathode 34 and the target 22 are not parallel, such as is illustrated in FIGS. 3 and 4. If the surface between the cathode and the target is not parallel, the focal spot 46 will be skewed, as illustrated in FIG. 4. As can be seen, the focal skew is caused by electron beams accelerating from the cathode and landing at different coordinates on the target.

Figure 5:
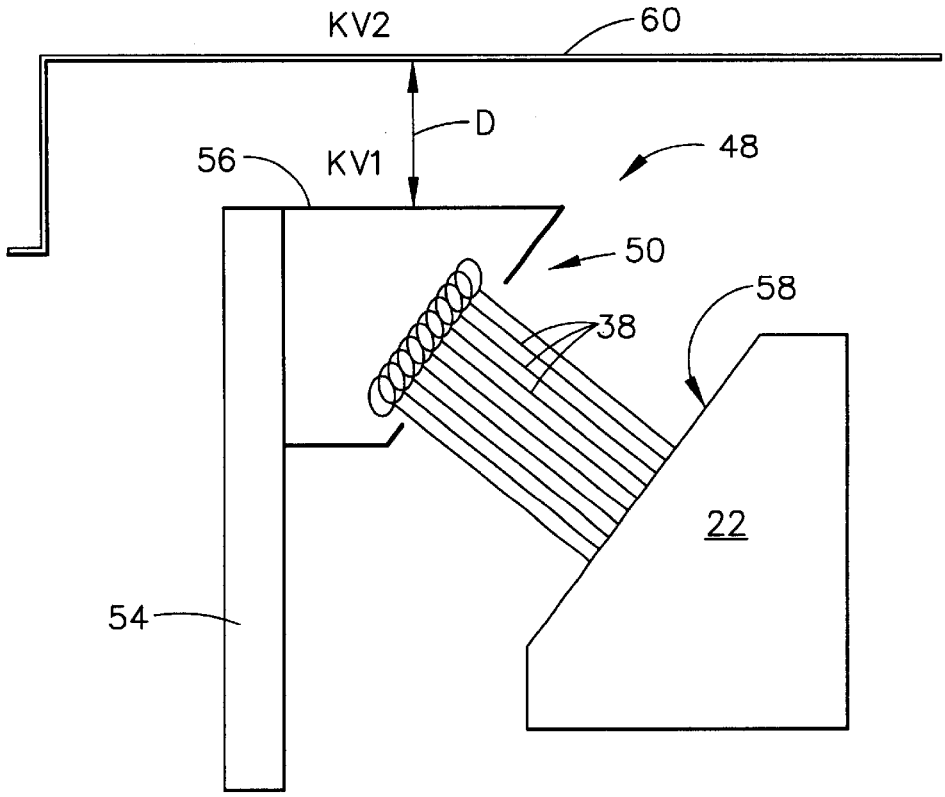
FIG. 5 is a cross-sectional illustration of a cathode constructed applying the teachings of the present invention, to overcome certain of the problems illustrated by FIGS. 2–4.

There are certain design options that can generate the paralleled surface between the cathode and the target. In the prior art, it is common practice to have the cathode arm at the same angle as the target. However, such a design reduces the spacing between the cathode and the frame which could cause high voltage arcs between the cathode and the frame. The present invention therefore proposes a target angle matching cathode structure 48, as is illustrated in FIG. 5. Rather than angle the cathode support arm 54, the cathode cup 56 is angled to match the angle of the target surface 58. The target angle matching technique for matching the angle of the target and the angle of the cathode generates a parallel surface 50 between the cathode and the target 22. This, in turn, minimizes the opportunity of the focal spot 46 in FIG. 4 to be skewed. That is, since KV1 is significantly less in the target angle matching structure of FIG. 5, as compared to the angled cathode arm structure of the prior art, the focal skew is minimized.

It is a further advantage of the angle matching cathode structure of the present invention that increasing the gap or distance D between the cathode and the frame 60. Referring to FIG. 5, the electric field is equal to the value of KV1 minus KV2, divided by the distance D. Thus, the increased distance D minimizes the probability of occurrence of discharges between the angled cathode 56 and the frame 60. Additionally, the increased distance D decreases the potential for high voltage arcing between the angled cathode 56 and the frame 60. Furthermore, when space limitations exist, the structure of the present invention is advantageous over the prior art.

It will be obvious to those skilled in the art that various modifications and variations of the present invention are possible without departing from the scope of the invention, which provides for a parallel surface between the cathode and the target in an x-ray tube assembly, by providing a target angle matching cathode structure.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotating x-ray tube comprising:

an anode assembly;

a target associated with the anode assembly for distributing heat generated at a focal spot;

a cathode for emitting a high-energy electron beam for focus on the anode; and a target angle matching cathode cup for creating a parallel surface between the cathode and the target.

2. A rotating x-ray tube as claimed in claim 1 further comprising a frame for containing and sealing the cathode and anode assembly.

3. A rotating x-ray tube as claimed in claim 2 further comprising a gap between the cathode and the frame.

4. A rotating x-ray tube as claimed in claim 3 wherein the target angle matching cathode cup maximizes the gap.

5. A rotating x-ray tube as claimed in claim 1 wherein focal spot skew is minimized.

6. A cathode structure for an x-ray tube, the x-ray tube having an x-ray tube target for distributing heat generated at a focal spot, the cathode structure comprising:

a cathode for emitting a high-energy electron beam for focus on an x-ray emissive region of an anode;

a linear cathode support arm for supporting the cathode and the cathode structure; and a cathode cup angled to match in parallel relation a facing surface of the target.

7. A cathode structure as claimed in claim 6 wherein the cathode cup angle generates a parallel surface between the cathode and the target.

8. A cathode structure as claimed in claim 6 further comprising a frame for containing the cathode.

9. A cathode structure as claimed in claim 8 further comprising a gap between the cathode and the frame.

10. A cathode structure as claimed in claim 9 wherein the angled cathode cup maximizes the gap.

* * * * *